US012736297B2

(12) United States Patent
Fredrickson et al.

(10) Patent No.: US 12,736,297 B2
(45) Date of Patent: Sep. 15, 2026

(54) MUZZLE DEVICE ADAPTER SYSTEM

(71) Applicant: Silencerco, LLC, West Valley City, UT (US)

(72) Inventors: Lyle Fredrickson, West Valley City, UT (US); Clayton Hutchings, Alpine, UT (US)

(73) Assignee: SilencerCo Weapons Research, LLC, West Valley City, UT (US)

( * ) Notice: Subject to any disclaimer, the term of this patent is extended or adjusted under 35 U.S.C. 154(b) by 0 days.

(21) Appl. No.: 18/380,012

(22) Filed: Oct. 13, 2023

(65) Prior Publication Data

US 2024/0142191 A1 May 2, 2024

Related U.S. Application Data

(60) Provisional application No. 63/381,596, filed on Oct. 31, 2022.

(51) Int. Cl.
*F41A 21/32* (2006.01)

(52) U.S. Cl.
CPC ..... *F41A 21/325* (2013.01)

(58) Field of Classification Search
None
See application file for complete search history.

(56) References Cited

U.S. PATENT DOCUMENTS 3,455,586 A 7/1969 Kurtzmann
4,229,059 A 10/1980 Dever
4,403,814 A 9/1983 Koss et al.
4,893,426 A * 1/1990 Bixler ..... F16B 7/20 89/14.05
4,944,213 A 7/1990 Ewert
5,559,302 A * 9/1996 Latka ..... F41A 21/325 89/14.05
6,887,189 B2 5/2005 Schiff
7,353,740 B1 4/2008 Hoffman
7,588,122 B2 9/2009 Brittingham
7,610,710 B2 * 11/2009 Brittingham ..... F41A 21/325 89/14.4

(Continued)

FOREIGN PATENT DOCUMENTS

DE 3624167 A1 3/1987
DE 10213292 A1 10/2003

(Continued)

*Primary Examiner* — Derrick R Morgan

(74) *Attorney, Agent, or Firm* — Asgaard Patent Services, LLC; F. Wayne Thompson, Jr.

(57) ABSTRACT

Subject matter related to firearms is described. An adapter may include a channel that extends along an exterior of the adapter in a helical pattern. The helical pattern may be configured to advance the adapter into a complementary component based on a rotation of the adapter, the complementary component, or both. Based on the advancement of the adapter into the complementary component, a sidewall of the channel may be forced against a sidewall of a ridge of the complementary component. The channel may lock with the ridge based on a rotation of the adapter, a rotation of the complementary component, or a combined rotation of the adapter and the complementary component that is less than 180 degrees.

20 Claims, 7 Drawing Sheets

(56) References Cited

U.S. PATENT DOCUMENTS

| | | | | |
|---|---|---|---|---|
| 7,905,170 | B1 * | 3/2011 | Brittingham | F41A 21/34 89/14.4 |
| 8,186,261 | B2 | 5/2012 | McNeill et al. | |
| 8,210,087 | B2 | 7/2012 | Latka | |
| 8,272,306 | B1 * | 9/2012 | Smith | F41A 21/30 89/14.4 |
| 8,701,326 | B2 | 4/2014 | Zonshine | |
| 8,714,300 | B2 | 5/2014 | Johansen | |
| 8,997,621 | B1 | 4/2015 | Dater et al. | |
| 9,121,656 | B1 * | 9/2015 | Mckenzie | F41A 21/30 |
| 9,175,920 | B2 | 11/2015 | Moore | |
| 9,377,263 | B1 * | 6/2016 | Sy | F41A 21/325 |
| 9,513,078 | B1 * | 12/2016 | Fulton | F41A 21/325 |
| 9,631,888 | B2 | 4/2017 | Young | |
| 9,921,021 | B1 | 3/2018 | Graham, II | |
| 9,958,227 | B2 | 5/2018 | Whitson | |
| 10,082,355 | B2 * | 9/2018 | Addis | F41A 21/36 |
| 10,088,261 | B1 | 10/2018 | Oglesby | |
| 10,156,411 | B2 | 12/2018 | Thompson | |
| 10,180,300 | B2 | 1/2019 | Schirmer | |
| 10,184,745 | B1 | 1/2019 | Fulton | |
| 10,222,165 | B2 | 3/2019 | Niswander et al. | |
| 10,234,229 | B2 | 3/2019 | Lessard | |
| 10,234,237 | B1 | 3/2019 | Jager | |
| 10,274,279 | B2 | 4/2019 | Lee | |
| 10,337,820 | B2 | 7/2019 | Jager | |
| 10,386,147 | B1 | 8/2019 | Fan | |
| 10,612,878 | B1 * | 4/2020 | Salvador | F41A 21/325 |
| 10,641,573 | B2 | 5/2020 | Jen et al. | |
| 10,731,939 | B2 | 8/2020 | Na et al. | |
| 10,753,700 | B2 * | 8/2020 | Wolf | F41A 21/325 |
| 10,767,952 | B1 | 9/2020 | Till et al. | |
| 10,801,796 | B2 | 10/2020 | Kras | |
| 10,830,550 | B2 | 11/2020 | Wolf et al. | |
| 10,883,787 | B2 | 1/2021 | Palu et al. | |
| 10,883,788 | B2 | 1/2021 | Marcotte | |
| 11,054,208 | B2 | 7/2021 | Johansen et al. | |
| 11,143,477 | B1 * | 10/2021 | Oglesby | F41A 21/36 |
| 11,255,624 | B2 | 2/2022 | McRorey | |
| 11,391,532 | B2 | 7/2022 | Markut et al. | |
| 11,408,702 | B2 * | 8/2022 | Reis-Green | F41A 21/325 |
| 11,441,867 | B2 | 9/2022 | Magee et al. | |
| 11,486,670 | B1 * | 11/2022 | Lovas | F41A 21/325 |
| 11,713,936 | B1 | 8/2023 | Lowell et al. | |
| 11,732,989 | B2 | 8/2023 | Kras | |
| 11,761,725 | B1 * | 9/2023 | Sanders | F41A 21/36 89/14.3 |
| 11,988,475 | B2 | 5/2024 | Kunsky | |
| 12,169,109 | B2 | 12/2024 | Krnežić | |
| 12,181,241 | B2 | 12/2024 | Dawson, Jr. | |
| 12,222,176 | B2 | 2/2025 | Hibbitts | |
| 12,253,322 | B1 | 3/2025 | Vining | |
| 12,320,602 | B2 | 6/2025 | Magee et al. | |
| 12,320,605 | B2 | 6/2025 | Wilson | |
| 2006/0060076 | A1 * | 3/2006 | Dueck | F41A 21/325 89/14.4 |
| 2006/0291764 | A1 | 12/2006 | Ravindra et al. | |
| 2007/0292067 | A1 | 12/2007 | Ravindra et al. | |
| 2008/0156183 | A1 * | 7/2008 | Brittingham | F41A 21/30 89/14.4 |
| 2010/0139145 | A1 * | 6/2010 | Brittingham | F41A 21/325 42/90 |
| 2010/0154278 | A1 | 6/2010 | Curry et al. | |
| 2010/0229712 | A1 * | 9/2010 | Graham | F41A 21/34 42/76.01 |
| 2013/0133976 | A1 * | 5/2013 | Johansen | F41A 21/325 181/223 |
| 2014/0075800 | A1 | 3/2014 | Morris, Jr. | |
| 2015/0253098 | A1 | 9/2015 | Russell et al. | |
| 2016/0102935 | A1 * | 4/2016 | Young | F41A 21/325 42/76.01 |
| 2016/0202013 | A1 * | 7/2016 | Lessard | F41A 21/325 89/14.05 |
| 2017/0030672 | A1 * | 2/2017 | Larue | F41A 21/325 |
| 2017/0205178 | A1 | 7/2017 | Niswander et al. | |
| 2018/0245872 | A1 * | 8/2018 | Jen | F41A 21/325 |
| 2018/0292164 | A1 * | 10/2018 | Thompson | F41A 21/36 |
| 2019/0154388 | A1 | 5/2019 | Jager | |
| 2019/0204040 | A1 * | 7/2019 | Mackey | F41A 21/481 |
| 2019/0353446 | A1 * | 11/2019 | Kras | F41A 21/325 |
| 2020/0224989 | A1 * | 7/2020 | Bundy | F41A 21/325 |
| 2020/0284542 | A1 * | 9/2020 | Winterseth | F41A 21/325 |
| 2021/0071978 | A1 * | 3/2021 | Washburn, III | F41A 21/30 |
| 2021/0231407 | A1 | 7/2021 | Salinas | |
| 2021/0389074 | A1 * | 12/2021 | Reis-Green | F41A 21/325 |
| 2022/0404112 | A1 | 12/2022 | Davis et al. | |
| 2023/0090595 | A1 | 3/2023 | Underwood et al. | |
| 2023/0228515 | A1 | 7/2023 | Roe et al. | |
| 2023/0228516 | A1 * | 7/2023 | Reis Green | F41A 21/325 89/14.05 |
| 2023/0266089 | A1 | 8/2023 | Krnezic | |
| 2023/0288164 | A1 * | 9/2023 | D'Amato | F41A 21/30 |
| 2023/0358496 | A1 | 11/2023 | Zaffiri | |
| 2024/0110758 | A1 | 4/2024 | Roe et al. | |
| 2024/0142191 | A1 | 5/2024 | Fredrickson et al. | |
| 2024/0191960 | A1 | 6/2024 | Toner et al. | |
| 2024/0240900 | A1 | 7/2024 | Shaw et al. | |
| 2025/0093121 | A1 | 3/2025 | Helmikkala et al. | |
| 2025/0130004 | A1 | 4/2025 | Roe | |
| 2025/0321070 | A1 | 10/2025 | Boomgaarden et al. | |

FOREIGN PATENT DOCUMENTS

| | | | |
|---|---|---|---|
| EP | 1930684 | A1 | 6/2008 |
| EP | 3705835 | A1 | 9/2020 |
| WO | 2016137858 | A1 | 9/2016 |

* cited by examiner

MUZZLE DEVICE ADAPTER SYSTEM

CROSS-REFERENCE

The present Application for Patent claims the benefit of U.S. Provisional Patent Application No. 63/381,596 by Fredrickson, entitled "MUZZLE DEVICE ADAPTER SYSTEM," filed Oct. 31, 2022, which is assigned to the assignee hereof, and which is expressly incorporated by reference in its entirety herein.

TECHNICAL FIELD

The present disclosure relates generally to firearms, including a muzzle device adapter system.

BACKGROUND

Firearm accessories (e.g., muzzle brakes, compensators, silencers, etc.) may be attached to a firearm (e.g., a muzzle end of a firearm). Attaching a firearm accessory to a firearm may include mating threads of the firearm accessory with complementary threads of a barrel of the firearm. Switching between different firearm accessories may include removing an attached firearm accessory and attaching a new firearm accessory—e.g., if the threads of the new firearm accessory are compatible with the threads of the barrel of the firearm.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a firearm accessory adapter comprising a body, a plurality of ridges, a channel, a central bore, and an annular face. The body has a front end opposite a rear end and a longitudinal axis extending from the front end to the rear end. The plurality of ridges extend from an exterior circumference of the body, each ridge having a front face and a rear face. The channel is formed on the exterior circumference of the body. The channel includes a substantially continuous rear sidewall and a front sidewall defined by the rear faces of the plurality of ridges. The front sidewall has a plurality of openings between the plurality of ridges. The annular face is at the front end of the body. The channel is configured to receive one or more interior ridges of a firearm accessory through one or more of the plurality of openings in the front sidewall, and is further configured such that rotation of the firearm accessory relative to the firearm accessory adapter draws the received one or more interior ridges toward the rear end and forces the one or more interior ridges into contact with the substantially continuous rear sidewall. The channel is further configured to draw the one or more interior ridges into a locked configuration with less than 180 degrees of rotation of the firearm accessory relative to the firearm accessory adapter. When the one or more interior ridges are in the locked configuration, the annular face is seated against an interior annular ledge of the firearm accessory.

Disclosed is an adapter for use with a firearm. The adapter comprises a body, a helical channel, a plurality of exterior ridges, and an annular face. The body has a front end, a rear end, and an exterior surface, the front end configured to be received into a firearm accessory and the rear end configured to receive a firearm barrel. The helical channel is on the exterior surface of the body and has a substantially continuous rear sidewall. The plurality of exterior ridges define a discontinuous front sidewall of the helical channel. The annular face is at the front end of the body. At least one opening between the plurality of exterior ridges is configured to receive, upon relative translational movement of the firearm accessory and the adapter, an interior ridge of the firearm accessory, and relative rotational movement between the firearm accessory and the adapter causes the helical channel to draw the interior ridge toward the rear end of the adapter and force a rear face of the interior ridge against the substantially continuous rear sidewall. The helical channel is further configured to draw the interior ridge into a locked configuration with less than 180 degrees of relative rotation between the firearm accessory and the adapter. When the interior ridge is in the locked configuration, the annular face is seated against an interior annular ledge of the firearm accessory.

Any aspect of any embodiment, in combination with any one or more aspects of any other embodiment(s).

Any one or more of the features disclosed herein.

Any one or more of the features as substantially disclosed herein.

Any one or more of the features as substantially disclosed herein, in combination with any one or more other features as substantially disclosed herein.

Any one of the aspects, features, or embodiments, in combination with any one or more other aspects, features, or embodiments.

In some examples, the adapter may include a unique threading pattern (e.g., interrupted threading patterns) that supports attachment to an additional quantity of complementary threading patterns—e.g., in fewer turns. However, such threading patterns may be susceptible to overtiming. Also, such threading patterns may fail to provide a sufficient seal between the firearm accessory and the adapter—e.g., gas may escape into a cavity that encircles the adapter and carbon may be deposited onto the adapter, among other challenges. In some examples, the insufficient seal results because the mechanism for attaching the adapter and the firearm accessory fails to maintain concentricity between the adapter and the firearm accessory during operation of the firearm.

As described herein, an adapter and a coupling may be configured to enable a firearm accessory to be quickly attached to a firearm with a desired orientation and a robust seal as well as to be quickly detached from the firearm. In some examples, the adapter and the firearm accessory may be attached to one another and detached from one another with less than a half turn of the adapter, the firearm accessory, or both.

FIG. 1 shows an example of a system that supports a muzzle device adapter system in accordance with examples disclosed herein.

Numerous additional features and advantages of the present disclosure will become apparent to those skilled in the art upon consideration of the embodiment descriptions provided below.

Additional features and advantages are described herein and will be apparent from the following description and figures.

DETAILED DESCRIPTION

An adapter for connecting a firearm accessory to a firearm may include threading that mates with complementary threading of a firearm accessory—e.g., to enable a user to switch between different firearm accessories. However, a pattern of the threading may only be compatible with a particular threading pattern. Accordingly, to attach different firearm accessories to the adapter, each of the firearm accessories may need to be configured with threads having the same complementary pattern. In some examples, to attach the firearm accessory to the adapter, the coupling of the firearm accessory may be interchanged with a coupling that has the complementary threads. The coupling for some firearm accessories, however, may be fixed and incompatible with the adapter; such firearm accessories may be unattachable to the adapter. For firearm accessories with interchangeable couplings, changing the coupling may take an extended period of time and may hinder an experience of the user. Moreover, even when the adapter and the firearm accessory include compatible threading, attaching the firearm accessory to the adapter may take an excessive quantity of operations, such as turns, and may result in the firearm accessory being attached with an undesired orientation (which may be referred to as an overtiming issue). In some cases, overtiming of the firearm accessory may attempt to be corrected by adding shims. However, adding shims may be an iterative, and time-consuming process and may not successfully prevent overtiming—e.g., if the shims are an incorrect thickness.

In some examples, the adapter may include a unique threading pattern (e.g., interrupted threading patterns) that support attachment to an additional quantity of complementary threading patterns—e.g., in fewer turns. However, such threading patterns may be susceptible to overtiming. Also, such threading patterns may fail to provide a sufficient seal between the firearm accessory and the adapter—e.g., gas may escape into a cavity that encircles the adapter and carbon may be deposited onto the adapter, among other challenges. In some examples, the insufficient seal results because the mechanism for attaching the adapter and the firearm accessory fails to maintain concentricity between the adapter and the firearm accessory during operation of the firearm.

As described herein, an adapter and a coupling may be configured to enable a firearm accessory to be quickly attached to a firearm with a desired orientation and a robust seal as well as quickly detached from the firearm. In some examples, the adapter and the firearm accessory may be attached to one another and from one another with less than a half turn of the adapter, the firearm accessory, or both.

Figure 1:
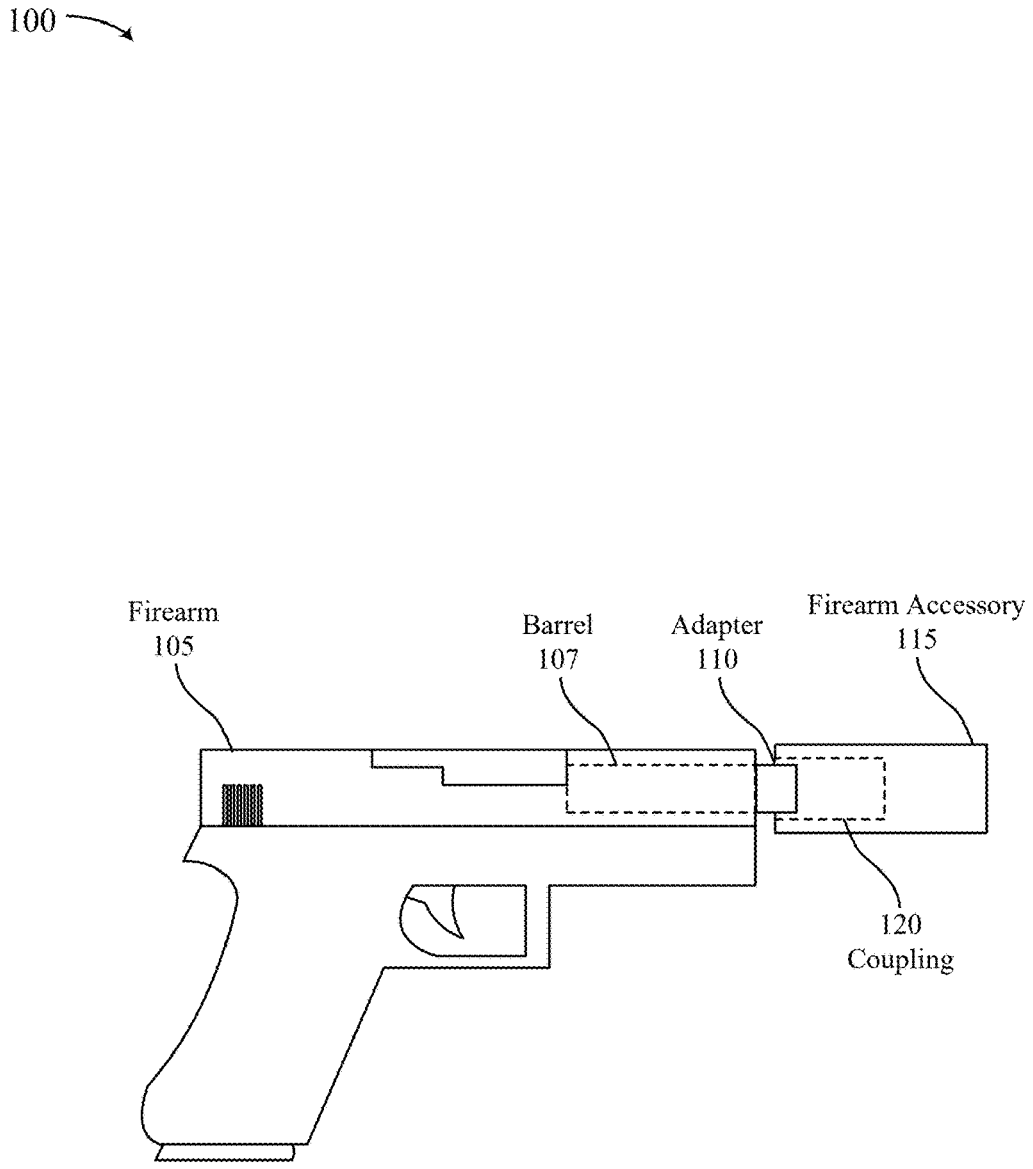
FIG. 1 shows an example of system that supports a muzzle device adapter system in accordance with examples disclosed herein.

FIG. 1 shows an example of system that supports a muzzle device adapter system in accordance with examples disclosed herein.

The system 100 includes the firearm 105, the adapter 110, and the firearm accessory 115. Though depicted as a pistol, the firearm 105 may be a different type of firearm, such as a rifle. The firearm 105 may include the barrel 107. In some examples, the barrel 107 is fixed and does not move when a bullet is discharged from the firearm 105. In other examples, the barrel 107 is not fixed and moves when a bullet is discharged from the firearm 105 (e.g., the barrel 107 may move backwards, tilt upwards, or both).

A user of the firearm 105 may wish to connect different firearm accessories to the barrel 107 throughout the operating life of the firearm 105. In some cases, a user may wish to switch between firearm accessories during a single session of use. The adapter 110 may be configured to provide a mechanism for attaching firearm accessories to, and detaching firearm accessories from, the firearm 105. The adapter 110 may include a mechanism (e.g., threads) for attaching to the firearm 105. The adapter 110 may also include a mechanism for attaching to the firearm accessory 115.

The firearm accessory 115 may be a muzzle brake, a compensator, a suppressor, or the like. The firearm accessory 115 may include a coupling 120 that interfaces with the adapter 110. In some examples, the coupling 120 is integrally formed with the firearm accessory 115 (e.g., as part of an elongate body that forms a muzzle brake). In other examples, the coupling 120 is formed in a component of the firearm accessory 115 (e.g., in a piston of a Nielsen device). In yet other examples, the coupling 120 is a separate component coupled with the firearm accessory 115—e.g., the coupling 120 may include threads that mate with complementary threads of the firearm accessory 115, a component of the firearm accessory 115, or both. In some examples, the coupling 120 may be referred to as an adapter (e.g., a second adapter).

If the firearm accessory 115 is a suppressor, the firearm accessory 115 may include a Nielsen device that temporarily decouples the barrel 107 from an external housing of the firearm accessory 115 when a bullet is discharged from the firearm—e.g., so the barrel 107 may move backward without having to also move the firearm accessory 115 backward. The Nielsen device may enable the barrel 107 to complete its full range of motion, ejecting the casing of a discharged bullet and loading the next cartridge. In some examples, the coupling 120 may be or include a piston of the Nielsen device.

An adapter for connecting a firearm accessory to a firearm may include threading that mates with complementary threading of a firearm accessory—e.g., to enable a user to switch between different firearm accessories. However, a pattern of the threading may only be compatible with a particular threading pattern. Accordingly, to attach different firearm accessories to the adapter, each of the firearm accessories may need to be configured with threads having the same complementary pattern. In some examples, to attach the firearm accessory to the adapter, the coupling of the firearm accessory may be interchanged with a coupling that has the complementary threads. The coupling for some firearm accessories, however, may be fixed and incompatible with the adapter; such firearm accessories may be unattachable to the adapter. For firearm accessories with interchangeable couplings, changing the coupling may take an extended period of time and may hinder an experience of the user. Moreover, even when the adapter and the firearm accessory include compatible threading, attaching the firearm accessory to the adapter may take an excessive quantity of operations, such as turns, and may result in the firearm accessory being attached with an undesired orientation (which may be referred to as an overtiming issue). In some cases, overtiming of the firearm accessory may attempt to be corrected by adding shims. However, adding shims may be an iterative, and time-consuming process and may not successfully prevent overtiming—e.g., if the shims are an incorrect thickness.

An adapter may include unique threading patterns (e.g., interrupted threading patterns) that support attachment to an additional quantity of complementary threading patterns—e.g., in fewer turns. However, such threading patterns may be susceptible to overtiming. Also, such threading patterns may fail to provide a sufficient seal between the firearm accessory and the adapter—e.g., gas may escape into a cavity that encircles the adapter and carbon may be deposited onto the adapter. In some examples, the insufficient seal results because the mechanism for attaching the adapter and the firearm accessory fails to maintain concentricity between the adapter and the firearm accessory during operation of the firearm.

As described herein, an adapter (e.g., the adapter 110) and a coupling (e.g., the coupling 120) may be configured to enable a firearm accessory (e.g., the firearm accessory 115) to be quickly attached to a firearm (e.g., the firearm 105) with a desired orientation and a robust seal as well as quickly detached from the firearm. In some examples, the adapter and the firearm accessory may be attached to one another and detached from one another with less than a half turn of the adapter, the firearm accessory, or both.

The adapter 110 may include one or more mechanisms for quickly attaching to firearm accessory 115 with a desired timing and seal as well as for quickly detaching the firearm accessory 115 from the adapter. One mechanism for attaching and detaching the adapter 110 with the firearm accessory 115 may be a channel that extends along an exterior of the adapter 110 (e.g., in a helical pattern). Additional mechanisms may include a tapered surface at a rear of the adapter 110, a flat, annular cylinder at a front of the adapter 110, or orienting ridges. In some examples, the orienting ridges form at least a portion of the channel.

The coupling 120 may include one or mechanisms that are compatible with (e.g., complementary to) the quick attach/detach mechanism of the adapter 110. Accordingly, the coupling 120 may work with the adapter 110 to support quickly attaching to firearm accessory 115 with a desired timing and seal as well as for quickly detaching the firearm accessory 115 from the adapter. One mechanism for attaching and detaching the coupling 120 with the adapter 110 may include one or more ridges that protrude from an interior of the coupling 120 and interact with the channel of the adapter 110—e.g., when the adapter 110, the coupling 120, or both, are rotated. Additional mechanisms may include a tapered surface at a rear of the coupling 120 that is complementary to the tapered surface at the rear of the adapter 110 and an annular ledge that protrudes from an interior of the coupling 120 and interacts with the flat annular cylinder at the front of the adapter 110.

In some examples, rotating the adapter 110, the coupling 120, or both, causes a sidewall of the channel to be forced against a sidewall of the ridge. Accordingly, the channel may not act as a thread for the ridge but may instead provide a large square surface for the ridge to press against when the adapter 110, the coupling 120, or both, are rotated. Rotating the adapter 110, the coupling 120, or both, may also cause the tapered surface of the adapter 110 to be pressed against the tapered surface of the coupling 120. And rotating the adapter 110, the coupling 120, or both, may cause the annular cylinder at the front of the adapter 110 to be pressed against the annular ledge of the coupling 120.

By configuring an adapter and complementary coupling for quick attachment and detachment, a user may quickly switch between different firearm accessories—e.g., without interchanging the coupling. Additionally, by using rotation to press a channel of an adapter against an opposing ridge of a coupling (with contrast to a threading action), the adapter and coupling may lock with one another in less than half of a turn, reducing a duration for attaching and detaching the adapter and the coupling and simplifying the timing of the connection.

By including an annular cylinder at the front of the adapter and an opposing annular ledge in the coupling, the timing of the connection may be further simplified (and in some cases prevented) and a robust seal (e.g., that prevents gas and carbon deposits from reaching the adapter), may be formed between the front of the adapter and the ledge. The interface between the annular cylinder and the annular ledge may also serve to maintain concentricity between the adapter and the firearm accessory, preventing the adapter or firearm accessory from skewing relative to one another.

By including a tapered surface on the exterior of the adapter and an opposing tapered surface on the interior of the coupling, an additional robust seal may be formed between the adapter and the coupling, preventing gas from escaping from through the adapter.

Figure 2B:
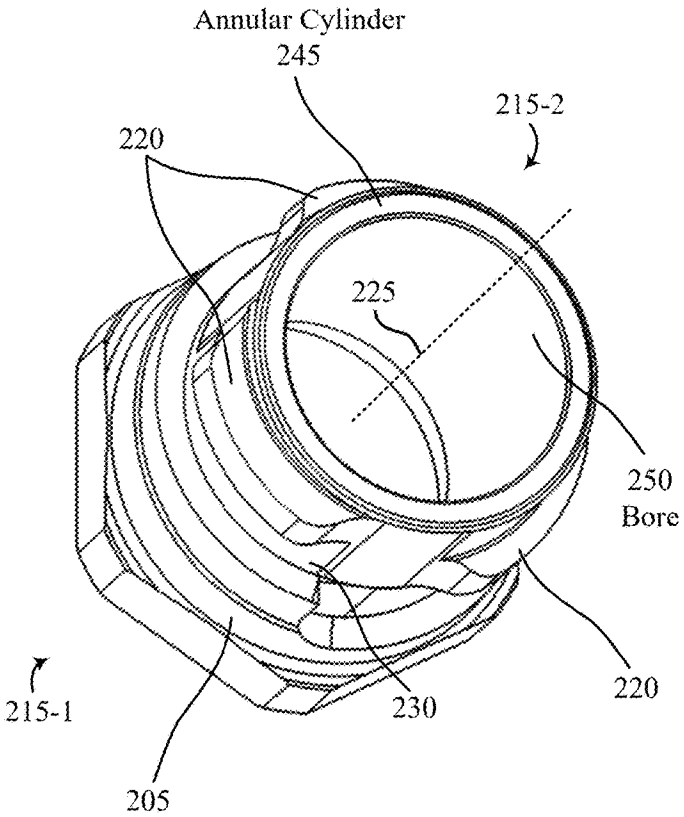
FIGS. 2A and 2B show views of examples of an adapter that supports a muzzle device adapter system in accordance with examples disclosed herein.
Figure 2A:
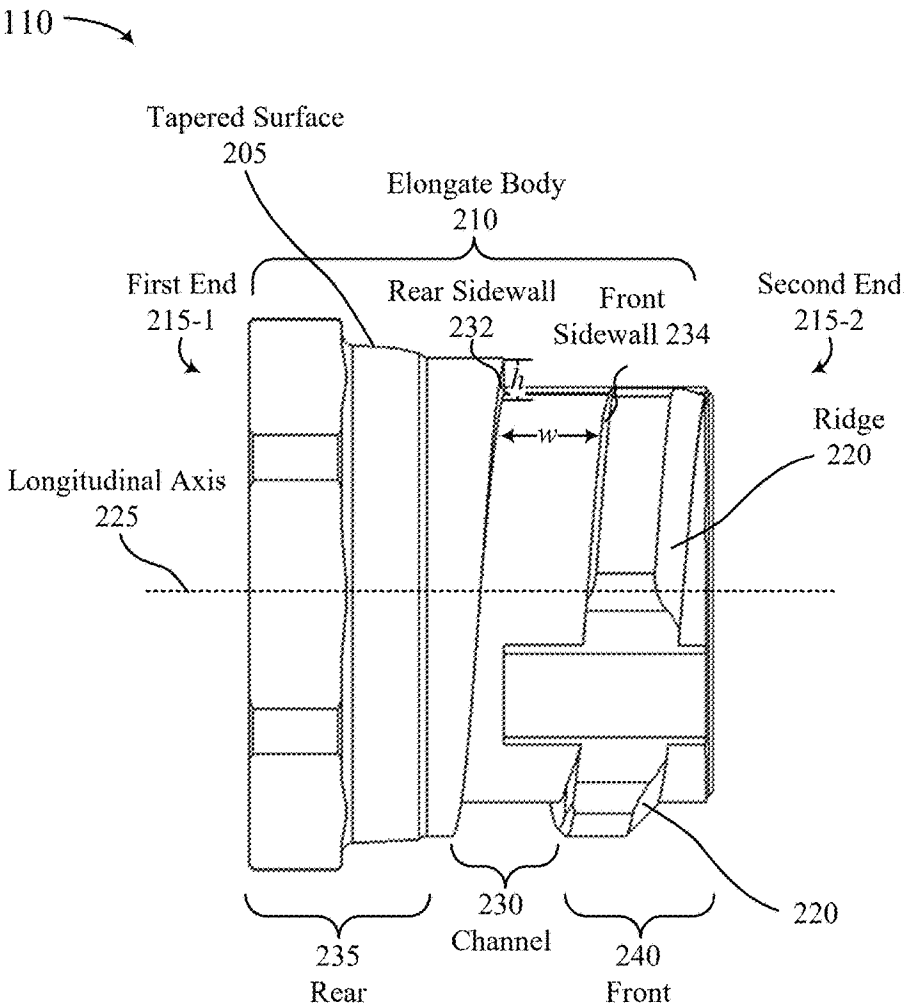

FIG. 2A shows a profile view of an example of an adapter that supports a muzzle device adapter system in accordance with examples disclosed herein.

The adapter 110 may be an example of or the same as the adapter 110 described herein, including with reference to FIG. 1. The adapter 110 may include the elongate body 210, which has the first end 215-1 and the second end 215-2. The first end 215-1 may be configured to attach to a barrel of a firearm—e.g., using threads. In some examples, multiple of such adapters may be configured with different thread patterns, and the adapter that is compatible with the thread pattern of the barrel of the firearm may be selected for attachment to the firearm. Thus, when attached to the firearm, the first end 215-1 may be adjacent to the barrel of the firearm. The second end 215-2 may be configured to attach to a coupling of a firearm accessory.

The longitudinal axis 225 may extend from the first end 215-1 through the elongate body 210 (e.g., through a center of the elongate body 210) to the second end 215-2. The front 240 of the elongate body 210 may include the second end 215-2, and the rear 235 of the elongate body 210 may include the first end 215-1. At the rear 235, an exterior of the elongate body 210 may form the tapered surface 205, which may extend around the exterior of the elongate body 210. In some examples, the tapered surface 205 may taper outward rather than inward (as depicted in FIG. 2A). At the front 240, the elongate body 210 may be chamfered into a flat leading face (which may also be referred to as the nose of the adapter 110).

The elongate body 210 may also include the channel 230 and the ridges 220. The channel 230 may extend along the exterior of the elongate body. In some examples, the channel 230 forms a helix in the exterior of the elongate body. A width of the channel 230 may be between 0.1 and 0.15 inches. A height of the channel may be between 0.03 and 0.06 inches. A pitch of the helix may be between 0.1 and 0.2 inches.

The ridges 220 may be used to form a portion of the channel. In some examples, the height of the ridges is equivalent to the height of the channel 230. The ridges 220 may be arranged across the exterior (e.g., the circumference) of the elongate body such that the adapter 110 is insertable into a piston when the adapter is in a particular orientation. The adapter 110 may include one or more ridges. In some examples, the adapter 110 does includes a single ridge 220 that extends along the exterior of the adapter 110, forming a continuous wall of the channel 230 (e.g., a front sidewall 234), where a slot may be formed through the ridge 220 for attaching to a coupling of a firearm accessory.

FIG. 2B shows an isometric view of an example of an adapter that supports a muzzle device adapter system in accordance with examples disclosed herein.

The adapter 110 may be an example of or the same as the adapter 110 described herein, including with reference to FIGS. 1, 2A, or both. FIG. 2B may depict the annular cylinder 245 of the adapter, where a leading face of the annular cylinder 245 may be flat. An interior of the annular cylinder 245 may also form the bore 250 through the adapter 110. The bore 250 may be configured to support the passage of a projectile discharged by a firearm. A circumference of the bore 250 may be greater than or equal to a circumference of a bore through a barrel of the firearm.

Figure 3A:
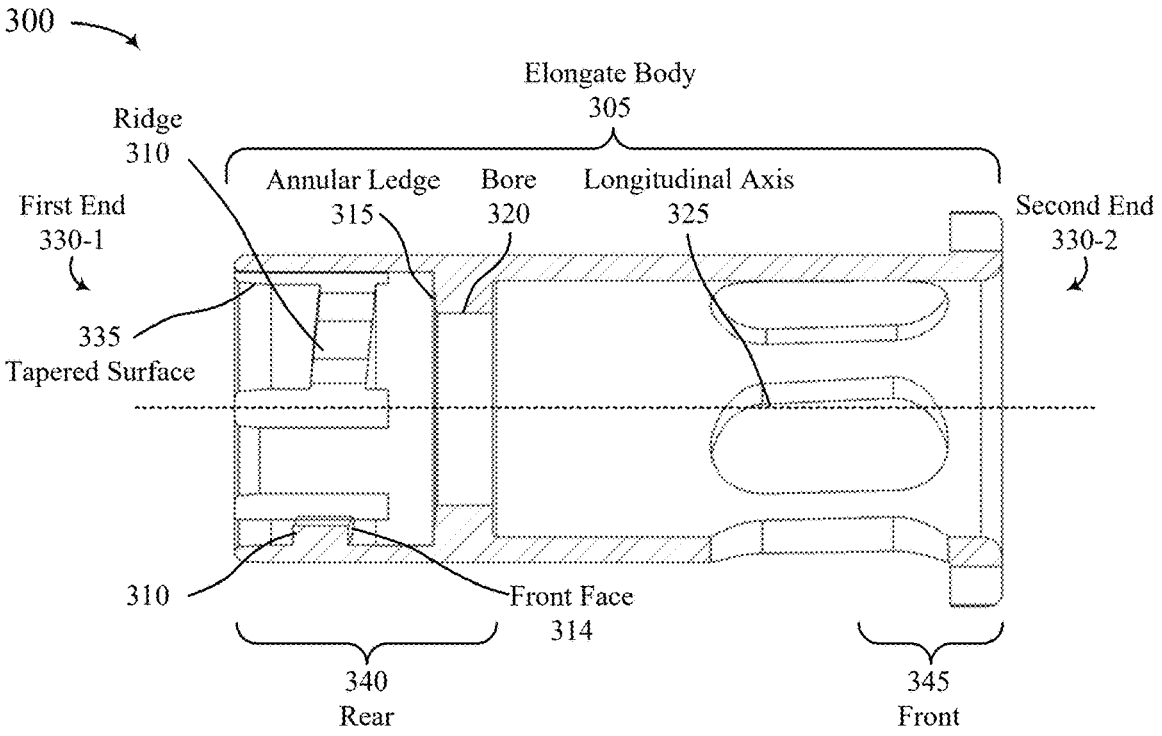
FIGS. 3A and 3B show views of examples of a piston that supports a muzzle device adapter system in accordance with examples disclosed herein.

FIG. 3A shows a cross-sectional view of an example of a piston that supports a muzzle device adapter system in accordance with examples as disclosed herein.

The piston 300 may be an example of or the same as the coupling 120 described with reference to FIG. 1. As described herein, in some examples, the piston 300 may be a component of a Nielsen device of a suppressor.

The piston 300 may include the elongate body 305, which has the first end 330-1 and the second end 330-2. The first end 330-1 may be configured to attach to the front of the adapter 110 described herein, including with reference to FIGS. 1, 2A, and 2B. Thus, when attached to the adapter 110, the first end 330-1 may be adjacent to the front 240 of the adapter 110, the second end 215-2 of the adapter, or both.

The longitudinal axis 325 may extend from the first end 330-1 through the elongate body 305 (e.g., through a center of the elongate body 305) to the second end 330-2. The front 345 of the elongate body 305 may include the second end 330-2, and the rear 340 of the elongate body 305 may include the first end 330-1. At the rear 340, an interior of the elongate body 305 may form the tapered surface 335, which may extend along the interior of the elongate body 305. The tapered surface 335 may be complementary to the tapered surface 205 described with reference to FIG. 2A. In some examples, the tapered surface 335 may taper inward rather than outward (as depicted in FIG. 3A)—e.g., if the tapered surface 205 tapers outward. Also at the rear 340, the annular ledge 315 may protrude from the interior of the elongate body 305. The annular ledge 315 may extend along the interior of the elongate body 305.

The elongate body 305 may also include the ridges 310 (e.g., including a rear face 312 and a front face 314). The ridges 310 may be configured to interface with (e.g., interlock with) the channel 230 described with reference to FIG. 2A. A height of the ridges 310 may be less than or equal to the height of the channel 230. Additionally, or alternatively, the width of the ridges 310 may be less than or equal to the width of the channel 230. In some examples, the ridges 310 may be arranged in a pattern that is complementary to the ridges 220 described with reference to FIG. 2A such that the adapter 110 and the piston 300 are attachable when the adapter 110 and the piston 300 are each in respective particular orientations. The piston 300 may include one or more ridges. In some examples, the piston 300 includes a quantity of ridges that is equivalent to a quantity of ridges included in the adapter 110.

Figure 3B:
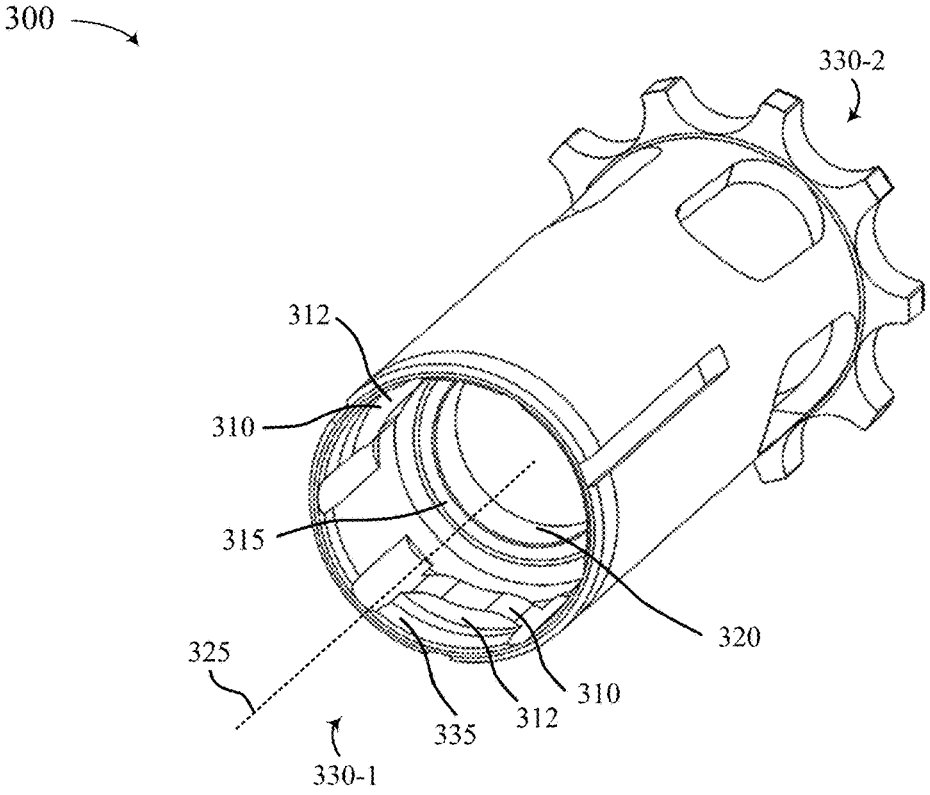

FIG. 3B shows an isometric view of an example of a piston that supports a muzzle device adapter system in accordance with examples as disclosed herein.

The piston 300 may be an example of or the same as the coupling 120 described herein, including with reference to FIG. 1 or the piston 300 described herein, including with reference to FIG. 3A. FIG. 3B depicts an exposed and flat face of the annular ledge 315. The face of the annular ledge 315 may be configured to interface with the face of the annular cylinder 245 as described herein, including with reference to FIG. 2B. An interior of the annular ledge 315 may also form the bore 320 through the piston 300. The bore 320 may be configured to support the passage of a projectile discharged by a firearm. A circumference of the bore 320 may be greater than or equal to a circumference of a bore through a barrel of the firearm.

In some examples, instead of integrally forming the ridges 310, the annular ledge 315, the bore 320, the tapered surface 335, or any combination thereof, with the elongate body 305 of the piston 300, an adapter (which may be referred to as a second adapter) may be configured with the ridges 310, the annular ledge 315, the bore 320, the tapered surface 335, or a combination thereof. The adapter may also include threads that mate with complementary threads formed on an interior wall of the elongate body 305 at the rear 340 of the elongate body 305 of the piston 300. Once the adapter is mated with the piston 300, the piston 300 may include (via the adapter) the ridges 310, the annular ledge 315, the bore 320, the tapered surface 335, or any combination thereof, and be capable of attaching to the adapter 110 described with reference to FIGS. 1 through 2B. In some examples, multiple of such adapters may be configured with different thread patterns, and an adapter of the adapters that is compatible with the thread pattern of the piston 300 may be selected for attachment to the piston 300. Such an adapter is described in more detail herein, including with reference to FIGS. 7A and 7B.

Figure 4:
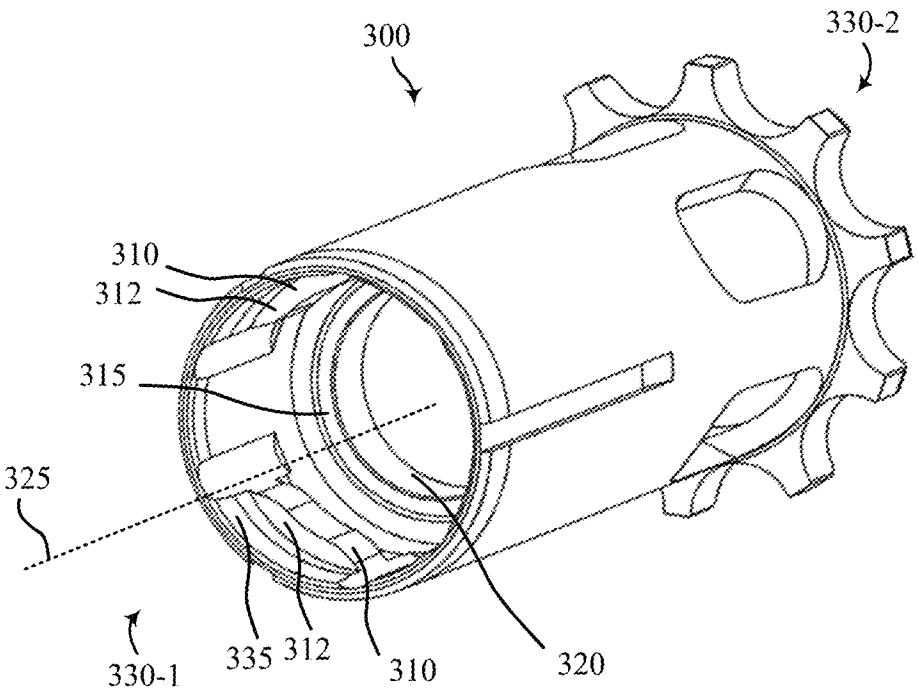
FIG. 4 shows an example of a disconnected adapter and piston assembly that supports a muzzle device adapter system in accordance with examples as disclosed herein.
Figure 4:
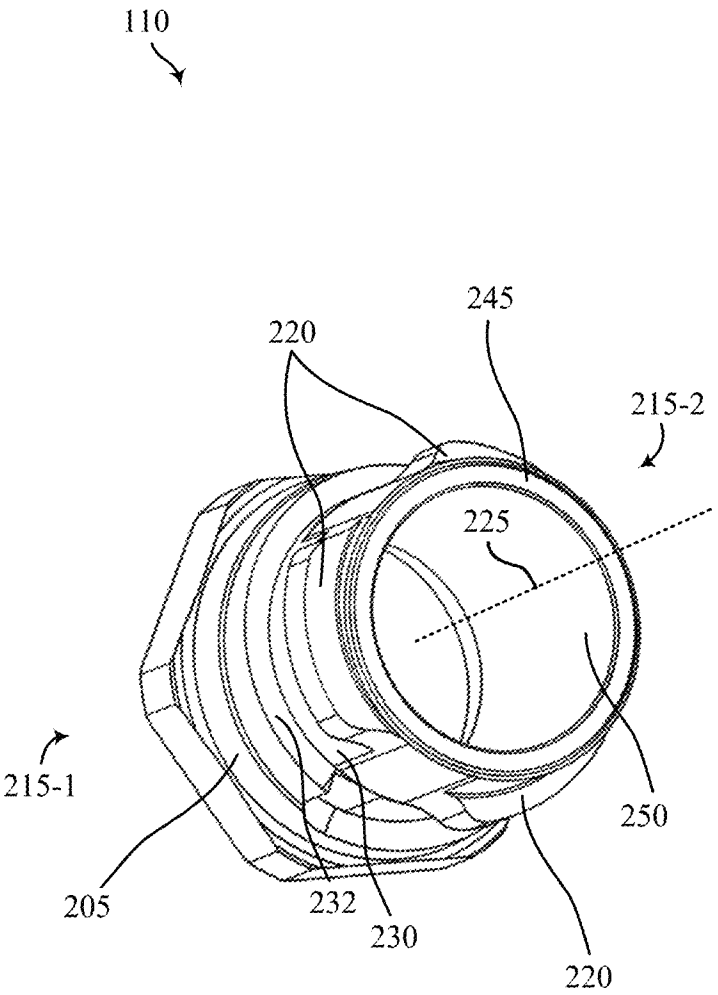

FIG. 4 shows an example of a disconnected adapter and piston assembly that supports a muzzle device adapter system in accordance with examples as disclosed herein. FIG. 4 depicts the adapter 110 described herein, including with reference to FIGS. 1, 2A, and 2B and the piston 300 described herein, including with reference to FIGS. 3A and 3B prior to an insertion of the adapter 110 into the piston 300.

Figure 5:
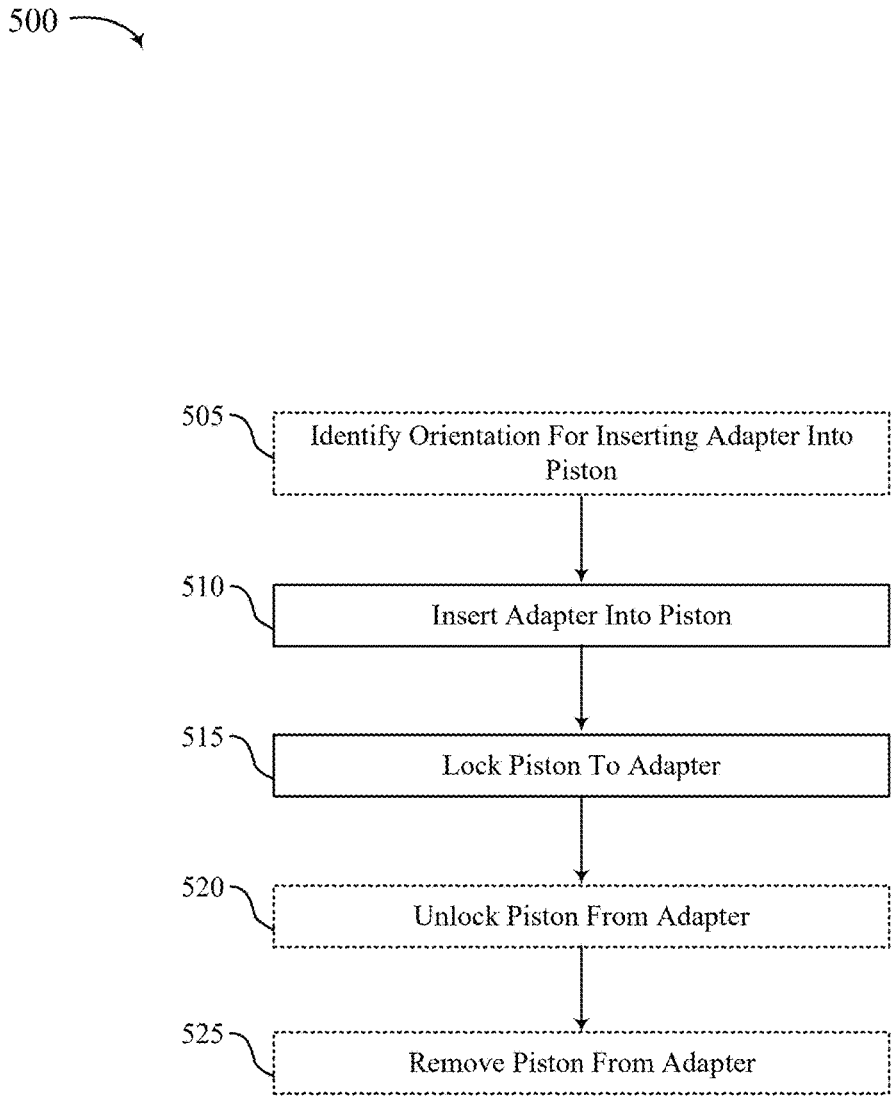
FIG. 5 shows an example of a set of operations for a muzzle device adapter system in accordance with examples as disclosed herein.

FIG. 5 shows an example of a set of operations for a muzzle device adapter system in accordance with examples as disclosed herein.

The flowchart 500 shows an example set of operations performed to support a muzzle device adapter system. For example, the flowchart 500 may include operations for attaching together the adapter 110 and the piston 300 shown as disconnected in FIG. 4.

One or more of the operations described in the flowchart 500 may be performed earlier or later, omitted, replaced, supplemented, or combined with another operation. Also, additional operations described herein may replace, supplement or be combined with one or more of the operations described in the flowchart 500. In some examples, the adapter 110 is attached to a barrel of a firearm before the operations of the flowchart 500 are performed.

At 505, prior to inserting the adapter 110 into the piston 300, the adapter 110, the piston 300, or both, may be positioned in respective orientations that enable the adapter 110 to be inserted into the piston 300. In some examples, the adapter 110 and the piston 300 may be oriented so that the respective ridges are interspersed across a circumference. In some cases, the ridges 220 of the adapter 110 may be pressed against the ridges 310 of the piston 300, and the adapter 110, the piston 300, or both, may be rotated until the ridges interlock with one another.

At 510, the adapter 110 may be inserted into the piston 300—e.g., after aligning the ridges of the adapter 110 and the ridges of the piston 300. Once the adapter 110 is inserted into the piston 300, a face of the annular cylinder 245 of the adapter 110 may be a certain distance (e.g., between 0.15 and 0.25 inches) away from a face of the annular ledge 315 of the piston 300. The distance may be configured to prevent overtiming when the adapter 110 and piston 30) are locked into position—e.g., by rotating the adapter 110, the piston 300, or both. That is, the distance may be configured so that the annular ledge 315 prevents the adapter 110 from further rotation after the adapter 110 has been turned a certain degree—e.g., after a sixteenth of a turn, an eighth of a turn, a quarter of a turn, a half of a turn, etc. Also, once the adapter 110 is inserted into the piston 300, one or more of the ridges 310 of the piston 300 may be positioned within the channel 230 of the adapter 110.

At 515, the adapter 110 and the piston 300 may be locked together—e.g., by rotating the adapter 110, the piston 300, or both. In some examples, the adapter 110 and the piston 300 may be locked together after the adapter 110 is rotated less than or equal to 180 degrees (e.g., 22.5 degrees, 45 degrees, 90 degrees), after the piston 300 is rotated less than or equal to 180 degrees (e.g., 22.5 degrees, 45 degrees, 90 degrees), or after the adapter 110 is rotated in a first direction less than or equal to 90 degrees (e.g., 11.25 degrees, 22.5 degrees, 45 degrees) and the piston is rotated in an opposing direction less than or equal to 90 degrees (e.g., 11.25 degrees, 22.5 degrees, 45 degrees). Based on rotating the adapter 110, the piston 300, or both, the channel 230 of the adapter 110 may draw the adapter 110 into the piston 300 (or the piston 300 onto the adapter 110)—e.g., due to the helical nature of the channel 230.

Based on rotating the adapter 110, the piston 300, or both, a sidewall (e.g., a rear face 312) of one or more of the ridges 310 of the piston 300 (e.g., the exposed sidewall of the lowermost of the ridges 310) may be pressed against a rear sidewall 232 of the channel 230 of the adapter 110 (e.g., the back wall of the channel 230). As the adapter 110, the piston 300, or both, are rotated further, a pressure between the sidewall (e.g., the rear face 312) of the one or more of the ridges 310 and the rear sidewall 232 of the channel 230 may increase—e.g., until additional rotation is no longer feasible, the adapter 110 and the piston 300 lock together, or both. The pressure between the sidewall (e.g., the rear face 312) of the one or more of the ridges 310 and the sidewall (e.g., the rear sidewall 232) of the channel 230 may occur at the first interface 605-1 described with reference to FIG. 6. In some examples, the pressure between the sidewall (e.g., the rear face 312) of the one or more of the ridges 310 and the sidewall (e.g., the rear sidewall 232) of the channel 230 may cause additional rotation to become infeasible after less than or equal to 180 degrees of rotation occurs. Accordingly, the configuration of the channel 230 and the ridges 310 may reduce a likelihood of overtiming, a degree of overtiming, or both, of the piston 300 such that the firearm accessory will be oriented in a desired orientation when the adapter 110 locks to the piston 300 (e.g., by reducing the amount of rotation needed to lock the adapter 110 and the piston 300 to less than or equal to a half-turn).

In some examples, before the sidewalls cause additional rotation to become infeasible, the annular cylinder 245 of the adapter 110 and the annular ledge 315 of the piston 300 may cause additional rotation to become infeasible—e.g., when the face of the annular cylinder 245 of the adapter 110 is pressed against the face of the annular ledge 315 of the piston 300 at the second interface 605-2 described with reference to FIG. 6. Accordingly, in addition, or alternative, to the interaction between the channel 230 and the ridges 310, the interaction between the annular cylinder 245 and the annular ledge 315 may be used to reduce a likelihood of overtiming, a degree of overtiming, or both, of the piston 300 such that the firearm accessory will be oriented in a desired orientation when the adapter 110 locks to the piston 300 (e.g., by stopping the rotation when the piston 300 reaches a desired orientation).

Once the rotation is completed and the adapter 110 and the piston 300 are locked together, the adapter 110 and the piston 300 may be concentric with one another. Accordingly, the longitudinal axis 225 of the adapter 110 may become aligned with the longitudinal axis 325 of the piston, forming the continuous longitudinal axis 615 described with reference to FIG. 6. Also, the bore 250 of the adapter 110 may become aligned with the bore 320 of the piston 300, forming the continuous bore 610 described with reference to FIG. 6. In addition to mitigating overtiming issues, the interaction between the face of the annular cylinder 245 of the adapter 110 and the annular ledge 315 of the piston may maintain a concentricity of the adapter 110 and the piston 300 throughout an operation of a firearm. For example, the interaction between the face of the annular cylinder 245 of the adapter 110 and the annular ledge 315 of the piston 300 may prevent either the adapter 110 or the piston 300 from becoming skewed relative to one another.

Moreover, the interaction between the face of the annular cylinder 245 of the adapter 110 and the annular ledge 315 of the piston may form a seal at the second interface 605-2 that prevents gas or discharge deposits from entering the cavity 620 described with reference to FIG. 6. The cavity 620 may be formed between the exterior of the adapter 110 and the interior of the piston 300. Accordingly, maintenance and cleaning of the adapter 110 may be reduced. Also, within the cavity 620, transverse forces to the exterior of the adapter 110 and the interior of the piston 300 (which may cause skewing) may be eliminated or reduced.

Additionally, once the rotation is completed, the tapered surface 205 of the adapter 110 may be pressed against the tapered surface 335 of the piston 300 at the third interface 605-3. Also, the interaction between the tapered surface 205 of the adapter 110 and the tapered surface 335 of the piston 300 may form a second seal at the third interface 605-3 that prevents gas from being expelled through the third interface 605-3, which may improve a performance of the attached firearm accessory. In some examples, the interaction between the channel 230 of the adapter 110 and the one or more ridges 310 of the piston 300), the interaction between the annular cylinder 245 of the adapter 110 and the annular ledge of the piston 300; and the interaction between the tapered surface 205 of the adapter 110 and the tapered surface 335 of the piston 300 each provide separate points for locking the adapter 110 and the piston 300 together.

At 520, the adapter 110 and the piston 300 may be unlocked from one another—e.g., so that a different firearm accessory may be attached to the firearm. For example, by rotating the adapter 110, the piston 300, or both, in the opposite direction as the direction used to lock the adapter 110 and the piston 300 together.

At 530, the piston 300 may be removed from the adapter 110. In some examples, a user may attach a different firearm accessory to the adapter 110 after removing the firearm accessory that includes the piston 300.

Although described in the context of the adapter 110 and the piston 300, the operations of the flowchart 500 may similarly be performed with a different coupling mechanism (e.g., a smooth cylinder that is attached to a firearm accessory). Also, the operations of the flowchart 500 may similarly be performed with a firearm accessory that connects directly to the adapter 110 (e.g., such as a muzzle brake or compensator). In such cases, one or more ridges, an annular ledge, and a tapered surface similar to the ridges 310, the annular ledge 315, and the tapered surface 335 may be similarly and integrally formed in an elongate body of the firearm accessory.

Figure 6:
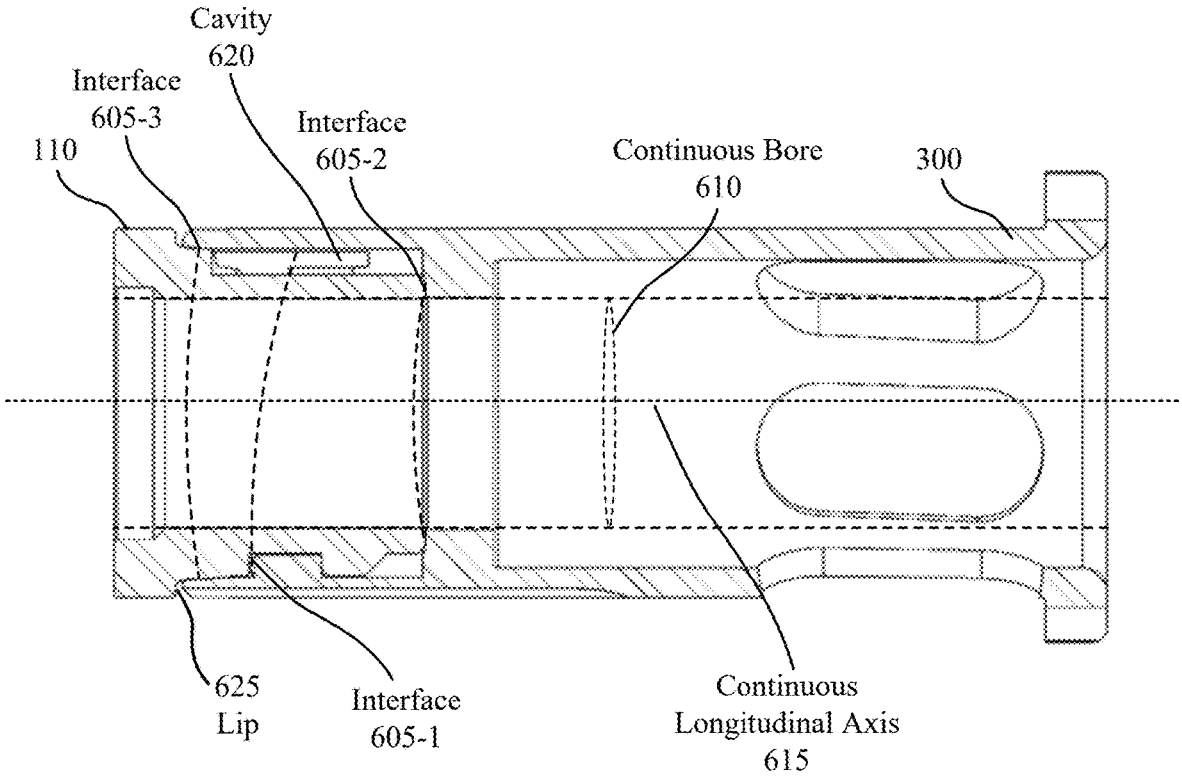
FIG. 6 shows an example of a connected adapter and piston assembly that supports a muzzle device adapter system in accordance with examples as disclosed herein.

FIG. 6 shows an example of a connected adapter and piston assembly that supports a muzzle device adapter system in accordance with examples as disclosed herein.

When the adapter 110 and the piston 300 are locked together, the adapter 110 and the piston 300 may be in contact at one or more of the interfaces 605. For example, a sidewall of a channel in the adapter 110 may be in contact with a sidewall of the ridge in the piston 300 at the first interface 605-1. Also, a face of an annular cylinder of the adapter 110 may be in contact with a face of an annular ledge of the piston 300 at the second interface 605-2. And a tapered surface of the adapter 110 may be in contact with a tapered surface of the piston 300. The interfaces 605 may extend around respective circumferences of the adapter 110 and the piston 300.

Each of the interfaces 605 may contribute to the locking of the adapter 110 and the piston 300 together. The second interface 605-2 may also be used to maintain a concentricity of the adapter 110 and the piston 300—e.g., by preventing the skewing of either the adapter 110 or the piston 300 during operation of the firearm. Additionally, the second interface 605-2 may provide a seal between the adapter 110 and the piston 300 that prevents gas and discharge deposits from entering the cavity 620. The third interface 605-3 may also be used to maintain a concentricity of the adapter 110 and the piston 300. Also, the third interface 605-3 may be used to form an additional seal that prevents gas from being expelled through the third interface 605-3, which may cause an increased amount of the gas to be processed by the firearm accessory, improving the performance of the firearm accessory.

Also, when the adapter 110 and the piston 300 are locked together, the continuous longitudinal axis 615 may extend through a center of the adapter 110 and a center of the piston 300. Similarly, the continuous bore 610 that supports the passage of a projectile from the firearm may extend through the adapter 110 and the piston 300.

As depicted in FIG. 6, the lip 625 at the rear of the adapter 110 may be separated from the rear of the piston 300 when the adapter 110 and the piston 300 are locked together. Maintaining this separation may prevent the lip 625 from contacting the rear of the piston 300 in a non-uniform way, which may impair a concentricity of the adapter 110 and the piston 300.

Figure 7B:
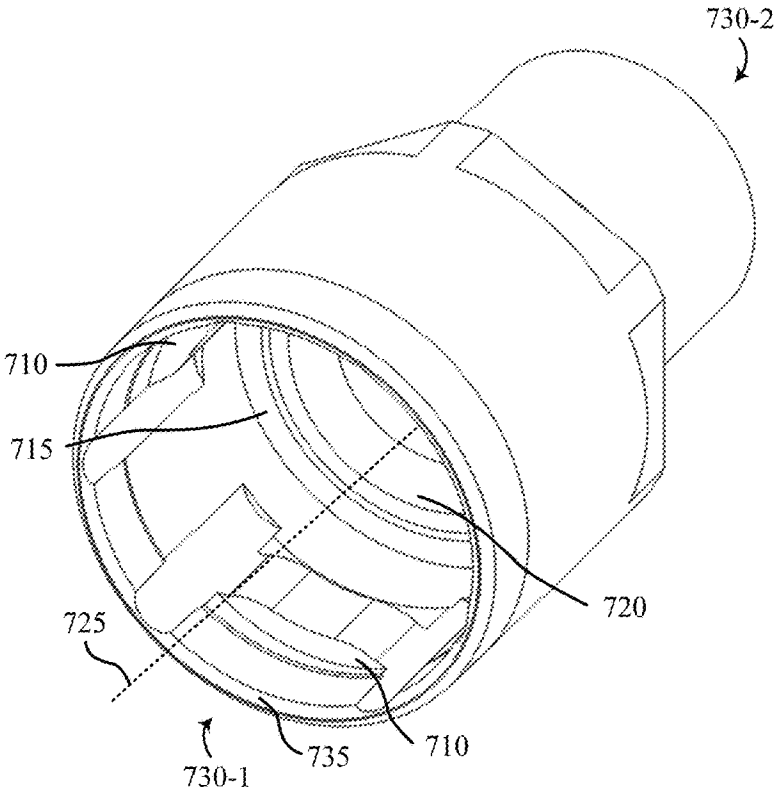
FIGS. 7A and 7B show views of examples of a second adapter that supports a muzzle device adapter system in accordance with examples disclosed herein.
Figure 7A:
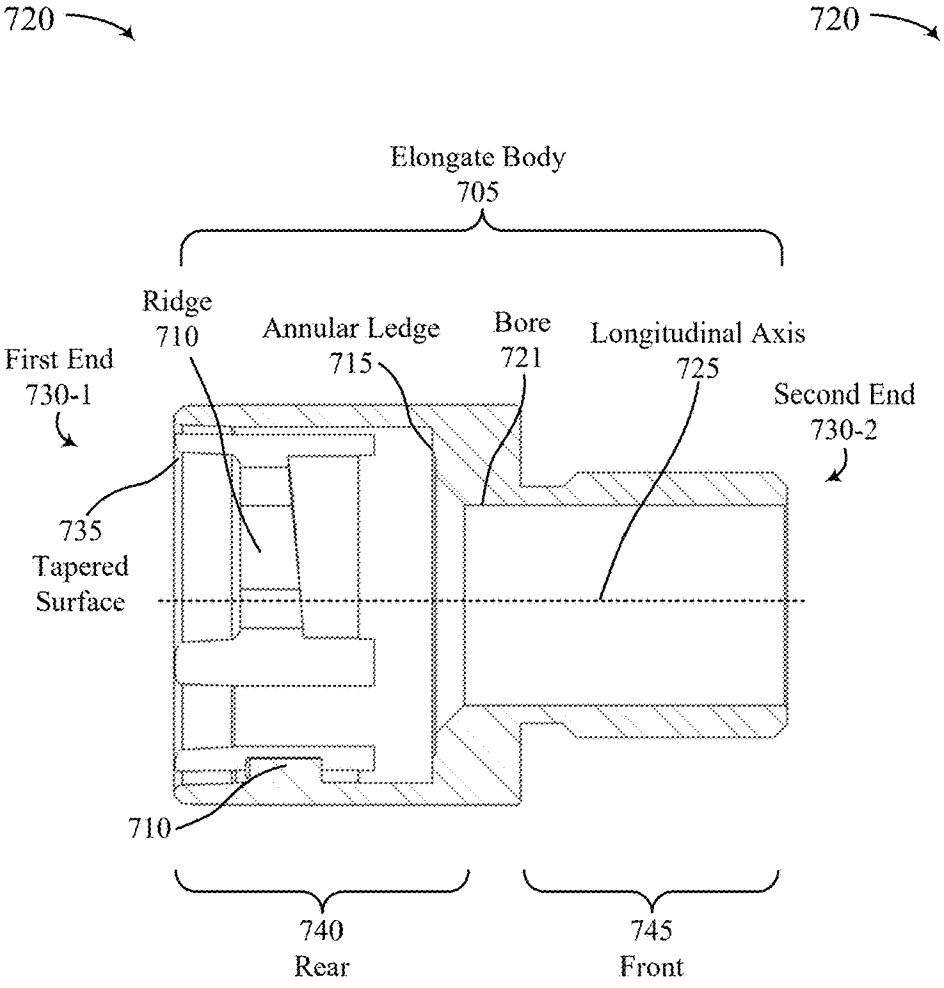

FIG. 7A shows a cross-sectional view of an example of a coupling that supports a muzzle device adapter system in accordance with examples disclosed herein.

The second adapter 720 may be an example of or the same as the coupling 120 described with reference to FIG. 1. In some examples, the rear 740 of the second adapter 720 may be configured similarly as the rear 340 of the piston 300 described with reference to FIG. 3A.

The second adapter 720 may include the elongate body 705, which has the first end 730-1 and the second end 730-2. The first end 730-1 may be configured to attach to the front of the adapter 110 described herein, including with reference to FIGS. 1, 2A, 2B, and 4. Thus, when attached to the adapter 110, the first end 730-1 may be adjacent to the front 240 of the adapter 110, the second end 215-2 of the adapter, or both.

The longitudinal axis 725 may extend from the first end 730-1 through the elongate body 705 (e.g., through a center of the elongate body 705) to the second end 730-2. The front 745 of the elongate body 705 may include the second end 730-2, and the rear 740 of the elongate body 705 may include the first end 730-1. At the rear 740, an interior of the elongate body 705 may form the tapered surface 735, which may extend along the interior of the elongate body 705. The tapered surface 735 may be complementary to the tapered surface 205 described with reference to FIG. 2A. In some examples, the tapered surface 735 may taper inward rather than outward (as depicted in FIG. 7A)—e.g., if the tapered surface 205 tapers outward. Also at the rear 740, the annular ledge 715 may protrude from the interior of the elongate body 705. The annular ledge 715 may extend along the interior of the elongate body 705.

The front 745 of the elongate body 705 may include a mechanism for attaching the second adapter 720 to another device (e.g., a piston, a compensator, a muzzle brake, a silencer, etc.). In some examples, the front 745 of the elongate body 705 includes internal or external threads that are configured to mate with complementary threads of the other device. In some examples, the threads on the front 745 of the elongate body 705 are configured similarly or the same as the threads on the barrel of a corresponding firearm. In some cases, the front 745 of the elongate body 705 includes a ½-28 thread.

The elongate body 705 may also include the ridges 710. The ridges 710 may be configured to interface with (e.g., interlock with) the channel 230 described with reference to FIG. 2A. A height of the ridges 710 may be less than or equal to the height of the channel 230. Additionally, or alternatively, the width of the ridges 710 may be less than or equal to the width of the channel 230. In some examples, the ridges 710 may be arranged in a pattern that is complementary to the ridges 220 described with reference to FIG. 2A such that the adapter 110 and the second adapter 720 are attachable when the adapter 110 and the second adapter 720 are each in respective particular orientations. The second adapter 720 may include one or more ridges. In some examples, the second adapter 720 includes a quantity of ridges that is equivalent to a quantity of ridges included in the adapter 110.

FIG. 7B shows an isometric view of an example of a coupling that supports a muzzle device adapter system in accordance with examples disclosed herein.

The second adapter 720 may be an example of or the same as the coupling 120 described herein, including with reference to FIG. 1. FIG. 7B may depict an exposed and flat face of the annular ledge 715. The face of the annular ledge 715 may be configured to interface with the face of the annular cylinder 245 as described herein, including with reference to FIG. 2B. An interior of the annular ledge 715 may also form the bore 721 through the second adapter 720. The bore 721 may be configured to support the passage of a projectile discharged by a firearm. A circumference of the bore 721 may be greater than or equal to a circumference of a bore through a barrel of the firearm.

In some examples, the second adapter 720 may be attached to a firearm accessory (e.g., using threads at the front 745 of the second adapter 720). In some examples, the second adapter 720 is selected from a set of similar adapters that have different thread configurations, where the second adapter 720 is selected for matching the thread configuration of the firearm accessory. Once the second adapter 720 is attached to the firearm accessory, the firearm accessory and the second adapter 720 may be attached/detached from a complementary adapter (e.g., the adapter 110 described with reference to FIGS. 1, 2A, 2B, 4, and 6) attached to a firearm—e.g., as similarly described with reference to FIG. 5. In another example, the second adapter 720 may first be attached to the complementary adapter (e.g., as similarly described with reference to FIG. 5), and then the firearm accessory may be attached to the second adapter 720.

It should be noted that the methods described herein describe possible implementations, and that the operations and the steps may be rearranged or otherwise modified and that other implementations are possible. Further, portions from two or more of the methods may be combined.

A system is described. The following provides an overview of aspects of the system as described herein:

Aspect 1: A system (100), including: a firearm accessory (115), where: a first end (330-1) of an elongate body (305) of the firearm accessory is configured to be positioned toward a firing end of a barrel (107) of a firearm (105), a second end (330-2) of the elongate body of the firearm accessory opposes the first end of the elongate body of the firearm accessory, a first longitudinal axis (325) extending from the first end of the elongate body of the firearm accessory to the second end of the elongate body of the firearm accessory, and a ridge (310) protrudes from an interior wall of the elongate body of the firearm accessory; and an adapter (110) for the firearm accessory, where: a first end (215-1) of an elongate body (210) of the adapter is configured to be positioned toward the firing end of the barrel of the firearm, a second end (215-2) of the elongate body of the adapter opposes the first end of the elongate body of the adapter and is configured to be positioned within the elongate body of the firearm accessory, a second longitudinal axis (225) extending from the first end of the elongate body of the adapter to the second end of the elongate body of the adapter, and a channel (230) extends along an exterior of the elongate body of the adapter in a pattern that is configured to pull the elongate body of the adapter into the elongate body of the firearm accessory based at least in part on a rotation of the elongate body of the firearm accessory, a rotation of the elongate body of the adapter, or both, and where a sidewall of the channel is configured to be forced against an opposing sidewall of the ridge of the elongate body of the firearm accessory based at least in part on an advancement of the elongate body of the adapter into the elongate body of the firearm accessory.

Aspect 2: The system of aspect 1, where: the channel is configured to lock with the ridge based at least in part on the rotation of the elongate body of the firearm accessory, the rotation of the elongate body of the adapter, or both, and the rotation of the elongate body of the firearm accessory is less than 180 degrees, the rotation of the elongate body of the adapter is less than 180 degrees, or a combined rotation of the elongate body of the firearm accessory and the elongate body of the adapter is less than 180 degrees.

Aspect 3: The system of aspect 2, where: a tapered surface (205) on an exterior of the elongate body of the adapter and at a rear (235) of the adapter is configured to contact an opposing tapered surface (335) on an interior of the elongate body of the firearm accessory and at a rear (340) of the elongate body of the firearm accessory based at least in part on the rotation of the elongate body of the firearm accessory, the rotation of the elongate body of the adapter, or both, the rear of the adapter includes the first end of the elongate body of the adapter, and the rear of the elongate body of the firearm accessory includes the first end of the elongate body of the firearm accessory.

Aspect 4: The system of aspect 3, where: an interface (605-3) between the tapered surface of the adapter and the opposing tapered surface of the firearm accessory are configured to form a gas seal.

Aspect 5: The system of any of aspects 2 through 4, where: a face of an annular cylinder (245) at a front (240) of the adapter is configured to contact a face of an annular ledge (315) at a rear (340) of the elongate body of the firearm accessory based at least in part on the rotation of the elongate body of the firearm accessory, the rotation of the elongate body of the adapter, or both, the front of the adapter includes the second end of the elongate body of the adapter, and the rear of the elongate body of the firearm accessory including the first end of the elongate body of the firearm accessory.

Aspect 6: The system of aspect 5, where: the face of the annular cylinder and the face of the annular ledge are planar, the first longitudinal axis and the second longitudinal axis form a continuous longitudinal axis (615) that extends from the second end of the elongate body of the firearm accessory to the first end of the elongate body of the adapter based at least in part on the contact between the face of the annular cylinder of the adapter and the face of the annular ledge of the elongate body of the firearm accessory, and the face of the annular cylinder of the adapter and the face of the annular ledge of the elongate body of the firearm accessory are positioned along a plane that is transverse to the continuous longitudinal axis based at least in part on the contact between the face of the annular cylinder of the adapter and the face of the annular ledge of the elongate body of the firearm accessory.

Aspect 7: The system of any of aspects 5 through 6, where: the annular ledge of the elongate body of the firearm accessory forms a bore (320) of the firearm accessory and the annular cylinder of the adapter forms a bore (250) of the adapter, the annular cylinder of the adapter overlaps with the annular ledge of the elongate body of the firearm accessory forming a continuous bore (610) that extends through the adapter and the firearm accessory, the continuous bore including the bore of the firearm accessory and the bore of the adapter, and the first longitudinal axis and the second longitudinal axis form a continuous longitudinal axis (615) that extends through a center of the bore of the firearm accessory, a center of the bore of the adapter, and a center of the continuous bore.

Aspect 8: The system of any of aspects 5 through 7, where: the annular ledge is configured to retain concentricity between a bore (250) of the adapter and a bore (320) of the firearm accessory based at least in part on the contact between the face of the annular cylinder of the adapter and the face of the annular ledge of the elongate body of the firearm accessory.

Aspect 9: The system of any of aspects 5 through 8, where: an interface (605-2) between the face of the annular cylinder and the face of the annular ledge is configured to form a gas seal.

Aspect 10: The system of any of aspects 5 through 9, where: the adapter is configured to be inserted into the elongate body of the firearm accessory with a specific orientation; and the adapter includes a plurality of ridges (220) that are arranged to indicate that the adapter is in the specific orientation.

Aspect 11: The system of any of aspects 1 through 10, where the adapter includes: threads at a rear (235) of the adapter that are configured to thread into complementary threads of the barrel of the firearm, and the rear of the adapter includes the first end of the elongate body of the adapter.

Aspect 12: The system of any of aspects 1 through 11, where: the first end of the elongate body of the adapter is adjacent to the firing end of the barrel of the firearm, and the first end of the elongate body of the firearm accessory is adjacent to the second end of the elongate body of the adapter.

Aspect 13: The system of any of aspects 1 through 12, where the pattern of the channel is a helical pattern.

Aspect 14: The system of any of aspects 1 through 13, where the firearm accessory further includes: a second adapter (720) that includes the ridge that protrudes from the interior wall of the elongate body, where the second adapter includes threads that are configured to thread into complementary threads of the first end of the elongate body of the firearm accessory.

An apparatus is described. The following provides an overview of aspects of the apparatus as described herein:

Aspect 15: A firearm accessory (115), including: an elongate body (305), where: a first end (330-1) of the elongate body is configured to be positioned toward a firing end of a barrel of a firearm, a second end (330-2) of the elongate body opposes the first end of the elongate body, and a ridge (310) protrudes from an interior wall of the elongate body, where a sidewall of the ridge is configured to be forced against an opposing sidewall of a channel of an adapter (110) based at least in part on a rotation of the firearm accessory, a rotation of the adapter, or both.

Aspect 16: The firearm accessory of aspect 15, where: the ridge is configured to lock with the channel based at least in part on the rotation of the firearm accessory, the rotation of the adapter, or both, and the rotation of the firearm accessory is less than 180 degrees, the rotation of the adapter is less than 180 degrees, or a combined rotation of the firearm accessory and the adapter is less than 180 degrees.

Aspect 17: The firearm accessory of any of aspects 15 through 16, where: a tapered surface (335) on an interior of the elongate body and at a rear (340) of the elongate body is configured to contact an opposing tapered surface (205) at a rear of the adapter based at least in part on the rotation of the firearm accessory, the rotation of the adapter, or both, and the rear of the elongate body includes the first end of the elongate body.

Aspect 18: The firearm accessory of any of aspects 15 through 17, where: an annular ledge (315) protrudes from the interior wall of the elongate body at a rear (340) of the elongate body, where a face of the annular ledge is configured to contact a face of an annular cylinder of the adapter based at least in part on the rotation of the firearm accessory, the rotation of the adapter, or both.

Aspect 19: The firearm accessory of aspect 18, where: the annular ledge defines at least a portion of a bore of the firearm accessory.

Aspect 20: The firearm accessory of any of aspects 15 through 19, where: the first end of the elongate body is configured to be positioned adjacent to a second end (215-2) of the adapter that opposes a first end (215-1) of the adapter that is adjacent to the barrel of the firearm.

Aspect 21: The firearm accessory of any of aspects 15 through 20, further including: a second adapter (720) that includes the ridge that protrudes from the interior wall of the elongate body, where the second adapter includes threads that are configured to thread into complementary threads of the first end of the elongate body.

An apparatus is described. The following provides an overview of aspects of the apparatus as described herein:

Aspect 22: An adapter (110), including: an elongate body (210), where: a first end (215-1) of the elongate body is configured to be positioned toward a firing end of a barrel (107) of a firearm (105), a second end (215-2) of the elongate body opposes the first end of the elongate body, and a channel (230) extends along an exterior of the elongate body in a helical pattern, where the helical pattern of the channel is configured to advance the elongate body into a firearm accessory (115) based at least in part on a rotation of the firearm accessory, a rotation of the adapter, or both, and where a sidewall of the channel is configured to be forced against an opposing sidewall of a ridge (310) of the firearm accessory based at least in part on an advancement of the elongate body into the firearm accessory.

Aspect 23: The adapter of aspect 22, where: the channel is configured to lock with the ridge based at least in part on the rotation of the firearm accessory, the rotation of the adapter, or both, and the rotation of the firearm accessory is less than 180 degrees, the rotation of the adapter is less than 180 degrees, or a combined rotation of the firearm accessory and the adapter is less than 180 degrees.

Aspect 24: The adapter of any of aspects 22 through 23, where: a tapered surface (205) on an exterior of the elongate body of the adapter and at a rear (235) of the adapter is configured to contact an opposing tapered surface (335) at a rear (340) of an elongate body (305) of the firearm accessory based at least in part on the rotation of the firearm accessory, the rotation of the adapter, or both, and the rear of the adapter includes the first end of the elongate body of the adapter.

Aspect 25: The adapter of any of aspects 22 through 24, where: an annular cylinder (245) at a front (240) of the adapter is configured to contact a face of an annular ledge (315) at a rear (340) of an elongate body (305) of the firearm accessory based at least in part on the rotation of the firearm accessory, the rotation of the adapter, or both, and the front of the adapter includes the second end of the elongate body.

Aspect 26: The adapter of aspect 25, where: the annular cylinder defines at least a portion of a bore (250) of the adapter.

Aspect 27: The adapter of any of aspects 25 through 26, where: a plurality of ridges (220) protrudes from an exterior of the elongate body, and the plurality of ridges is arranged to indicate that the adapter is in a specific orientation for inserting the adapter into the firearm accessory.

An apparatus is described. The following provides an overview of aspects of the apparatus as described herein:

Aspect 28: A first adapter (720), including: an elongate body (705), where: a first end (730-1) of the elongate body is configured to be positioned toward a firing end of a barrel (107) of a firearm (105), a second end (730-2) of the elongate body opposes the first end of the elongate body, and one or more ridges (710) protrude from an interior of the elongate body in a helical pattern, where the helical pattern of the one or more ridges is configured to advance the elongate body into a second adapter (110) based at least in part on a rotation of the first adapter, a rotation of the second adapter, or both, and where one or more sidewalls of the one or more ridges is configured to be forced against an opposing sidewall of a channel (230) of the second adapter based at least in part on an advancement of the elongate body into the second adapter.

Aspect 29: The first adapter of aspect 28, where the second end of the elongate body includes: threads that are configured to thread into complementary threads of a firearm accessory (115).

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the term "substantially" means that the modified characteristic (e.g., a verb or adjective modified by the term substantially) need not be absolute but is close enough to achieve the advantages of the characteristic.

As used herein, the terms "optional" or "optionally" mean that the subsequently described event or circumstance may or may not occur, and that the description includes instances where said event or circumstance occurs and instances where it does not.

The terms "if," "when," "based on," or "based at least in part on" may be used interchangeably. In some examples, if the terms "if," "when," "based on," or "based at least in part on" are used to describe a conditional action, a conditional process, or connection between portions of a process, the terms may be interchangeable.

The term "in response to" may refer to one condition or action occurring at least partially, if not fully, as a result of a previous condition or action. For example, a first condition or action may be performed and a second condition or action may at least partially occur as a result of the previous condition or action occurring (whether directly after or after one or more other intermediate conditions or actions occurring after the first condition or action).

The description set forth herein, in connection with the appended drawings, describes example configurations and does not represent all the examples that may be implemented or that are within the scope of the claims. The term "exemplary" used herein means "serving as an example, instance, or illustration" and not "preferred" or "advantageous over other examples." The detailed description includes specific details to providing an understanding of the described techniques. These techniques, however, may be practiced without these specific details. In some instances, well-known structures and devices are shown in block diagram form to avoid obscuring the concepts of the described examples.

In the appended figures, similar components or features may have the same reference label. Further, various components of the same type may be distinguished by following the reference label by a hyphen and a second label that distinguishes among the similar components. If just the first reference label is used in the specification, the description is applicable to any one of the similar components having the same first reference label irrespective of the second reference label.

As used herein, including in the claims, "or" as used in a list of items (for example, a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

The description herein is provided to enable a person skilled in the art to make or use the disclosure. Various modifications to the disclosure will be apparent to those skilled in the art, and the generic principles defined herein may be applied to other variations without departing from the scope of the disclosure. Thus, the disclosure is not limited to the examples and designs described herein but is to be accorded the broadest scope consistent with the principles and novel features disclosed herein.

What is claimed is:

1. A firearm accessory adapter comprising:

a body having a front end opposite a rear end and a longitudinal axis extending from the front end to the rear end;

a plurality of ridges extending from an exterior circumference of the body, each ridge having a front face and a rear face;

a channel formed on the exterior circumference of the body, the channel having a substantially continuous rear sidewall and a front sidewall defined by the rear faces of the plurality of ridges, the front sidewall having a plurality of openings between the plurality of ridges;

a central bore; and an annular face at the front end;

wherein the channel is configured to receive one or more interior ridges of a firearm accessory through one or more of the plurality of openings in the front sidewall, and is further configured such that rotation of the firearm accessory relative to the firearm accessory adapter draws the received one or more interior ridges toward the rear end and forces the one or more interior ridges into contact with the substantially continuous rear sidewall;

wherein the channel is further configured to draw the one or more interior ridges into a locked configuration with less than 180 degrees of rotation of the firearm accessory relative to the firearm accessory adapter; and wherein, when the one or more interior ridges are in the locked configuration, the annular face is seated against an interior annular ledge of the firearm accessory.

2. The firearm accessory adapter of claim 1, further comprising:

a tapered surface on the exterior circumference of the body, between the substantially continuous rear sidewall and the rear end;

wherein, when the one or more interior ridges are in the locked configuration, the tapered surface is in contact with an opposing tapered surface of the firearm accessory.

3. The firearm accessory adapter of claim 2, wherein:

an interface between the tapered surface of the firearm accessory adapter and the opposing tapered surface of the firearm accessory is configured to form a gas seal.

4. The firearm accessory adapter of claim 1, wherein the annular face defines a plane that is transverse to the longitudinal axis.

5. The firearm accessory adapter of claim 1, wherein, when the one or more interior ridges are in the locked configuration, the firearm accessory adapter and the firearm accessory form a continuous bore extending along the longitudinal axis.

6. The firearm accessory adapter of claim 1, wherein:

contact between the annular face and the interior annular ledge maintains concentricity between the central bore and a bore of the firearm accessory.

7. The firearm accessory adapter of claim 1, wherein:

an interface between the annular face and the interior annular ledge forms a gas seal.

8. The firearm accessory adapter of claim 1, wherein:

an arrangement of the plurality of ridges indicates a preferred orientation of the firearm accessory adapter relative to the firearm accessory.

9. The firearm accessory adapter of claim 1, further comprising:

internal threads proximate the rear end.

10. The firearm accessory adapter of claim 1, wherein:

the rear end of the body of the firearm accessory adapter is adjacent to a firing end of a barrel of a firearm; and a rear end of the firearm accessory is adjacent to the front end of the body of the firearm accessory adapter.

11. The firearm accessory adapter of claim 1, wherein the channel is helical.

12. The firearm accessory adapter of claim 1, wherein the plurality of ridges are arranged such that the firearm accessory adapter is insertable into the firearm accessory in a particular orientation.

13. An adapter for use with a firearm, comprising:

a body having a front end, a rear end, and an exterior surface, the front end configured to be received into a firearm accessory and the rear end configured to receive a firearm barrel;

a helical channel on the exterior surface, the helical channel having a substantially continuous rear sidewall;

a plurality of exterior ridges defining a discontinuous front sidewall of the helical channel; and an annular face at the front end;

wherein at least one opening between the plurality of exterior ridges is configured to receive, upon relative translational movement of the firearm accessory and the adapter, an interior ridge of the firearm accessory, and further wherein relative rotational movement between the firearm accessory and the adapter causes the helical channel to draw the interior ridge toward the rear end of the adapter and forces a rear face of the interior ridge against the substantially continuous rear sidewall;

wherein the helical channel is further configured to draw the interior ridge into a locked configuration with less than 180 degrees of relative rotation between the firearm accessory and the adapter; and wherein, when the interior ridge is in the locked configuration, the annular face is seated against an interior annular ledge of the firearm accessory.

14. The adapter of claim 13, wherein the exterior surface comprises a tapered portion, and wherein, when the interior ridge is in the locked configuration, the tapered portion contacts an interior tapered surface of the firearm accessory.

15. The adapter of claim 13, wherein the at least one opening comprises a plurality of openings, and the plurality of openings are configured to receive, upon relative translational movement of the firearm accessory and the adapter, a plurality of interior ridges.

16. The adapter of claim 13, wherein the plurality of exterior ridges are arranged such that the adapter is insertable into the firearm accessory in a particular orientation.

17. The adapter of claim 13, wherein the body defines a bore extending through the body.

18. The adapter of claim 17, wherein, when the interior ridge is in the locked configuration, the bore of the adapter and a bore of the firearm accessory form a continuous bore extending through the adapter and the firearm accessory.

19. The adapter of claim 17, wherein contact between the annular face and the interior annular ledge maintains concentricity between the bore of the adapter and a bore of the firearm accessory.

20. The adapter of claim 13, wherein an interface between the annular face and the interior annular ledge forms a gas seal when the interior ridge is in the locked configuration.

* * * * *